US006318558B1

(12) United States Patent
Exner

(10) Patent No.: US 6,318,558 B1
(45) Date of Patent: Nov. 20, 2001

(54) METHOD AND DEVICE FOR SEPARATING DIFFERENT ELECTRICALLY CONDUCTIVE PARTICLES

(76) Inventor: Hubertus Exner, Am Zauberberg 2 A, D-38667 Bad Harzburg (DE)

( * ) Notice: Subject to any disclaimer, the term of this patent is extended or adjusted under 35 U.S.C. 154(b) by 0 days.

(21) Appl. No.: 09/601,968

(22) PCT Filed: Feb. 9, 1999

(86) PCT No.: PCT/EP99/00845

§ 371 Date: Aug. 9, 2000

§ 102(e) Date: Aug. 9, 2000

(87) PCT Pub. No.: WO99/39831

PCT Pub. Date: Aug. 12, 1999

(30) Foreign Application Priority Data

Feb. 9, 1998 (DE) ..... 198 04 878

(51) Int. Cl.[7] ..... B03B 9/00; B07B 9/00

(52) U.S. Cl. ..... 209/2; 209/3; 209/215; 209/225; 209/218; 209/228; 505/400

(58) Field of Search ..... 209/3, 2, 225, 209/215, 218, 219, 228, 231; 505/400

(56) References Cited

U.S. PATENT DOCUMENTS

| | | | | |
|---|---|---|---|---|
| 401,415 | * | 4/1889 | Conkling . | |
| 731,043 | * | 6/1903 | Gates . | |
| 2,748,940 | * | 6/1956 | Roth . | |
| 4,609,109 | * | 9/1986 | Good | 209/636 |
| 4,743,364 | * | 5/1988 | Kyrazis | 209/212 |
| 4,828,685 | * | 5/1989 | Stephens | 209/11 |
| 5,047,387 | * | 9/1991 | Talmy et al. | 505/1 |
| 5,049,540 | * | 9/1991 | Park et al. | 505/1 |
| 5,182,253 | * | 1/1993 | Kishi et al. | 505/1 |
| 5,268,353 | * | 12/1993 | Ohara et al. | 505/1 |
| 5,919,737 | * | 7/1999 | Broide | 505/400 |

FOREIGN PATENT DOCUMENTS

| | | | |
|---|---|---|---|
| 0 339 195 B1 | | 6/1993 | (DE) . |
| 64-22359-A | | 1/1989 | (JP) . |
| 1-107857-A | * | 4/1989 | (JP) . |
| 1-107856-A | | 4/1989 | (JP) . |
| 1-130745-A | * | 5/1989 | (JP) . |
| 1-19352-A | * | 5/1989 | (JP) . |
| 1-155953-A | | 6/1989 | (JP) . |
| 1-179704-A | * | 7/1989 | (JP) . |
| 1-194951-A | | 8/1989 | (JP) . |
| 1-210044-A | * | 8/1989 | (JP) . |
| 1-304060-A | * | 12/1989 | (JP) . |
| WO-88/ 08619-A1 | * | 11/1988 | (WO) . |

OTHER PUBLICATIONS

CRC Handbook ofChemistry and Physics, 73rd Edition, 1992–1993, pp. 12–130 to 12–131 and 12–34 to 12–35.

* cited by examiner

*Primary Examiner*—Donald P. Walsh
*Assistant Examiner*—David A. Jones
(74) *Attorney, Agent, or Firm*—Barlow, Josephs & Holmes, Ltd.

(57) ABSTRACT

The invention relates for separating different electrically conductive particles, especially of waste materials, by means of an eddy-current separation, whereby the supplied particles to be separated are cooled. The invention also relates to an eddy-current separator provided for carrying out said method. The separator has a rotational magnet system and a transport system for guiding the particles to be separated along the magnet system. A cooling chamber through which the particles are guided is located immediately upstream from the magnet system. The conductivity of the non-iron metallic particles is increased by cooling thus allowing differential separation of these materials.

5 Claims, 2 Drawing Sheets

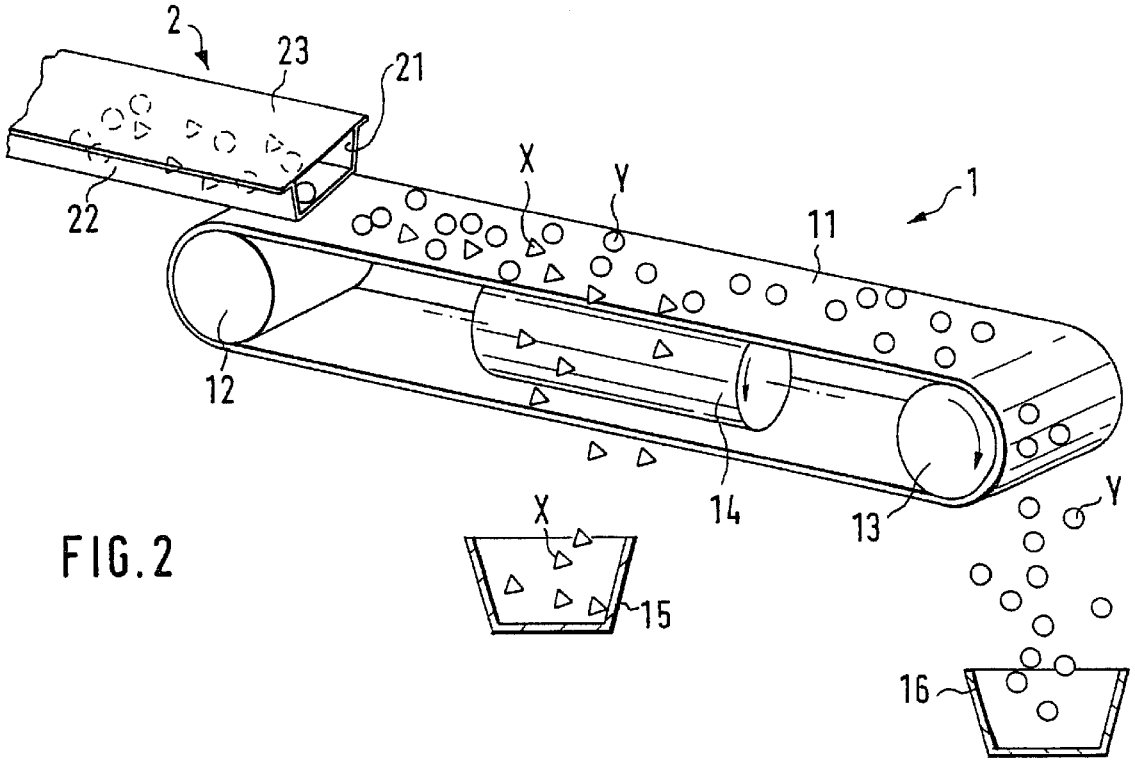
FIG. 2
FIG. 3
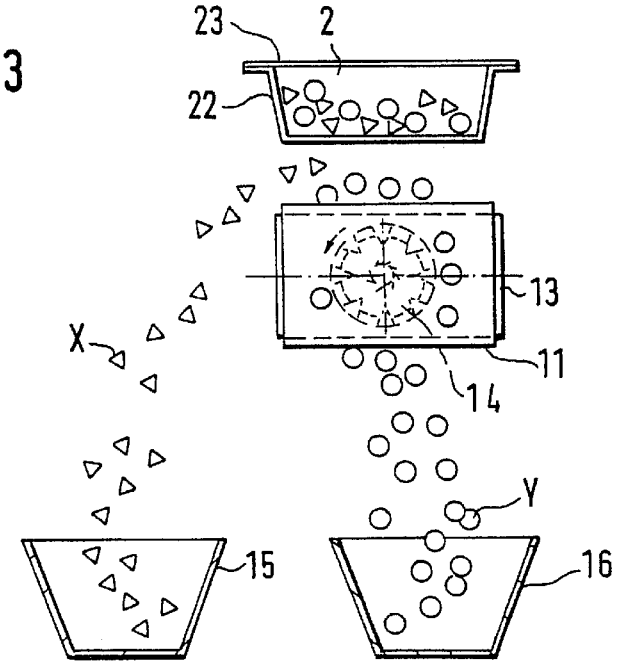

METHOD AND DEVICE FOR SEPARATING DIFFERENT ELECTRICALLY CONDUCTIVE PARTICLES

BACKGROUND OF THE INVENTION

The invention relates to a method for separating non-ferrous particles of different electrical conductivity, in particular of waste materials, and to a device for carrying out the method.

When separating useful materials, in particular waste materials, it is possible to separate ferromagnetic materials, i.e. in particular iron, without any problems by means of simple magnetic methods. Because of their different electrical conductivity, non-ferrous metals can be further separated from one another and from plastics materials following the removal of the ferromagnetic materials by means of eddy-current separation. In the eddy-current separator a current is induced and thus a force produced in an inducing magnetic field in the particles to be separated by the latter, irrespective of their conductivity, and this current and force expel the particles from the magnetic field. The deflection of non-ferrous metals in the eddy-current separator is in this case determined by the electrical conductivity $\sigma$ and the density $\rho$ (relative density) of the materials to be separated. With the density the same, increasing conductivity is accompanied by increasing eddy currents and a corresponding increase in the force that expels the particles from the inducing magnetic field. The force that is to be applied for the same quantitative effect increases with the density. $\sigma/\rho$ is therefore a suitable characteristic quantity for the qualitative assessment of the separating capacity.

Eddy-current separators of this kind are known in various configurations. For example, EP 0 305 881 A1 describes a method and a device for sorting non-ferrous metal particles by means of eddy-current separation. A conveyor belt runs around a rotating magnet system and the different particles are thrown off in different trajectory parabolas and can thus be sorted to a certain degree. As an improved version, EP 0 339 195 B1 describes a magnetic separator with a conveyor belt, which is guided over a belt drum consisting of non-electrically conductive material, to transport a fraction of particles of greater or lesser electrical conductivity which is to be sorted, with a magnet system which is driven so as to rotate in the belt drum at a higher rotational speed than that of the belt drum, and with a collecting vessel disposed in the material discharge zone of the belt drum for the separated electrically conductive particles. This publication indicates in particular how damage to the belt drum due to particles, in particular iron particles, coming between the conveyor belt and the belt drum can be prevented. This is achieved by a certain geometrical structure.

However the disadvantage of the known eddy-current separators lies in the fact that different non-ferrous metals can only be separated from one another with difficulty and subject to error. This is due in particular to the fact that the physical properties determining the separating capacity only differ slightly.

The object is therefore to improve the separation of non-ferrous metals from one another when using eddy-current separation.

SUMMARY OF THE INVENTION

This object is solved by a method for separating non-ferrous particles of different electrical conductivity, in particular of waste materials, in which the supplied particles to be separated are cooled and then subjected to eddy-current separation in the cooled state. A device for carrying out this method is characterised in that a cooling chamber through which the particles are guided is provided, and that an eddy-current separator (magnet system) is provided, to which the still cooled particles are fed in a transport stream.

As the electrical conductivity of non-ferrous metals increases as temperatures drop, and the density does not change significantly at the same time, it becomes easier to separate the different materials. The eddy currents induced in the particles increase superproportionally, so that the force acting on the particles is augmented accordingly. As a consequence, it is therefore also possible to separate different non-ferrous metals practically error-free with an eddy-current separator otherwise unchanged.

For example, the ratio $\sigma/\rho$ in the temperature range of 100–300 K differs for aluminium, magnesium, copper and zinc, as indicated in the graph represented in FIG. 1. The values are taken from: CRC Handbook of Chemistry and Physics, Editor: David R. Lide, Vol. 1992–93, 73rd issue, published by CRC Press, Boca Raton, etc.

The graph shows that there is an increase in both $\sigma/\rho$ for each element in absolute terms and $\Delta(\sigma/\rho)$ for each two elements as temperatures drop. A higher yield and a more accurate separation, especially below 150 K, can therefore be expected when separating waste.

DE 196 00 647 proposes a method for utilizing cable sleeves by means of cryogenics. In this case the cable sleeves are to be successively cooled to temperatures of around −85° C., so that they embrittle. This embrittlement enables them to be shattered in a hammer mill and the individual components of a cable sleeve thus made accessible to further sorting. After passing through the hammer mill, the particles resulting from the shattering process are by no means cooled, but rather heated, and there is no intention of separating non-ferrous metals.

The eddy-current separation should take place directly after cooling in order to make optimum use of the increased conductivity at the cooled particles.

As can be seen from the graph in FIG. 1, an increased separating capacity is to be detected in particular below 150 K. It is therefore preferable to cool the particles to 100–150 K. It is, moreover, sufficient to cool at least the surfaces of the particles to the desired temperature, as the eddy currents produced by the inducing magnetic fields essentially flow at the surface of the particles.

If liquid nitrogen is used to cool the particles, the latter are cooled simply and effectively. As the boiling point of nitrogen is approximately 80 K, the preferred temperature range can be reached at least at the surfaces of the particles. The nitrogen has no further influence on the process.

The different materials also have different coefficients of thermal conductivity; they therefore react to the cooling at different speeds and with different intensity. As this cooling process takes place over a finite time and the separation closely follows the cooling in terms of time, the temperature of the particles to be sorted differs, in spite of an identically operating cooling plant.

However this effect, felt to be disturbing on the first impression, may also be utilised: Since the thermal conductivity of a material to be sorted or separated is also a material constant and the plant-specific cooling also operates in a reproducible fashion, it is even possible to improve the separation by a suitable choice of parameters as a result of the electrical conductivity of one non-ferrous metal at a certain temperature specifically entering into competition with the electrical conductivity of the other non-ferrous metal at a completely different temperature and thus making separation easier. This effect can be detected experimentally according to the plant, as well as calculated beforehand theoretically and specifically used when separating certain compositions of the total transport stream.

In order to minimise unwanted heat absorption, the cooling chamber is formed as a closed channel with a feed opening and a delivery opening for the particles that are to be separated. The coolant introduced into the closed channel, for example liquid nitrogen, can be economically metered. The particles are fed through the channel by forming the channel as a chute or shaker conveyor. As the channel has an essentially rectangular cross section, there is no possibility of the particles to be separated agglomerating. The channel is preferably of the width of the downstream conveyor belt to the eddy-current separator. A conveyor belt of electrically non-conductive material has in particular proved successful for producing the transport stream guided along the rotatable magnet system.

The rotational axis of the rotatable magnet system should be disposed parallel to the transport stream of the particles to be separated to achieve an effective lateral deflection of the particles of the transport stream, which are of greater or lesser electrical conductivity, for example on the conveyor belt. The rotatable magnet system for one conveyor belt is preferably disposed between the top strand and the bottom strand of the conveyor belt.

BRIEF DESCRIPTION OF THE DRAWINGS

The invention is described in detail in the following in an embodiment on the basis of the accompanying figures, in which:

FIG. 2 is a three-dimensional view of an eddy-current separator according to the invention; and FIG. 3 is an end view of the device represented in FIG. 2.

DETAILED DESCRIPTION OF THE PREFERRED EMBODIMENT

Figure 1:
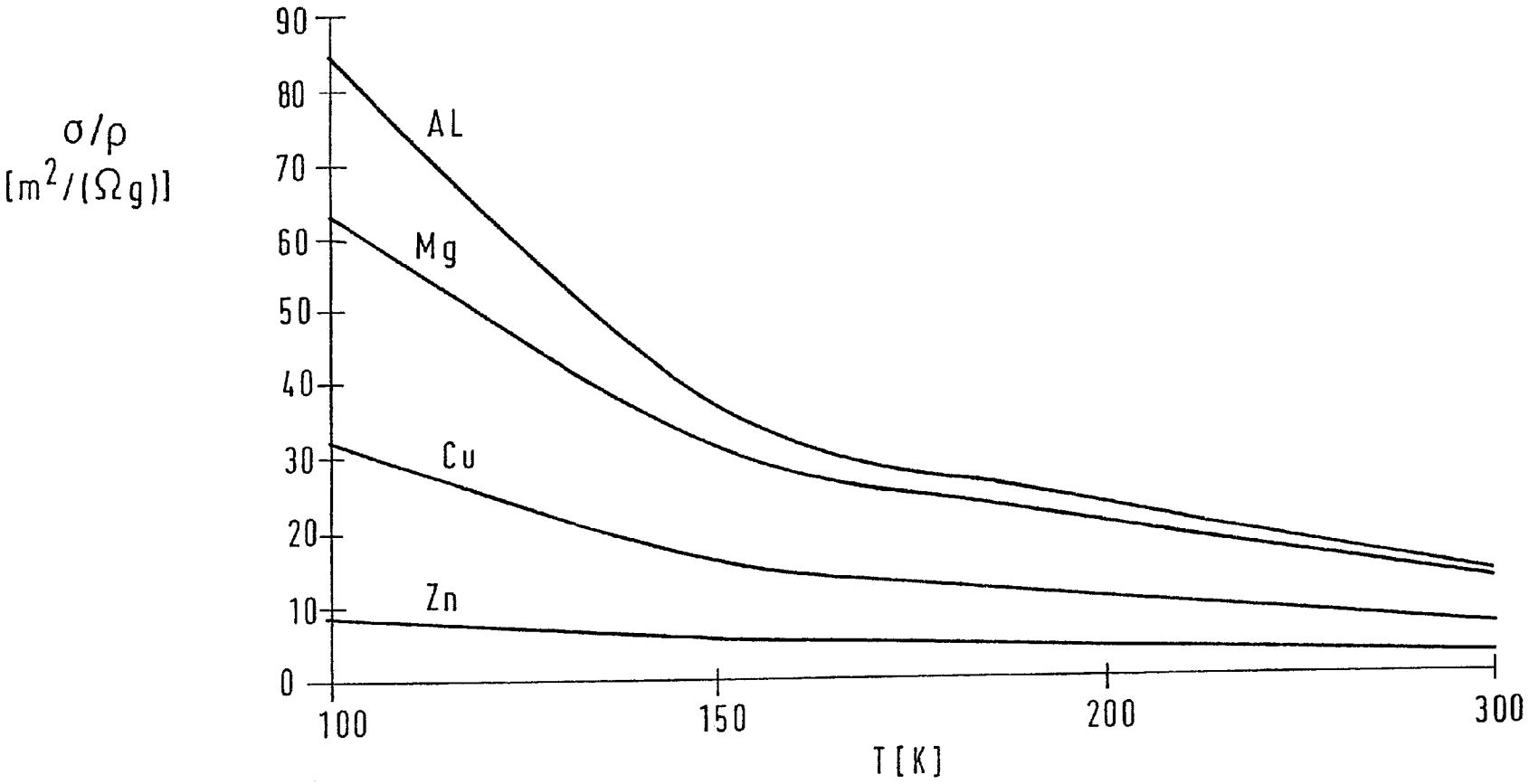
FIG. 1 is a graph of $\sigma/\rho$ in $m^2/\Omega\times g$ plotted against the absolute temperature T in K for the elements aluminum, magnesium, copper and zinc.

FIG. 1 shows a graph in which, as ordinate, the quotient of the electrical conductivity and density is plotted as characterisitic quantity for the qualitative assessment of the separating capacity for 4 non-ferrous metals against the temperature, which is represented as abscissa. It can clearly be seen that the lines diverge below 150 K, which is equivalent to an improved separating capacity of particles of these different elements.

FIG. 2 is a diagrammatic three-dimensional representation of a structure of a device according to the invention. The particle stream to be separated is guided through a cooling chamber 2 from the left. The cooling chamber 2 has an essentially rectangular cross section, as can be seen in the end view in FIG. 3. The cooling chamber 2 is elongate and comprises a feed opening, which is not represented, and a delivery opening 21, which is disposed directly above a conveyor belt 11.

The conveyor belt 11 is guided over deflector rolls 12, 13. A rotatable magnet system 14 is disposed between the top strand and the bottom strand of the conveyor belt 11. The rotational axis of the rotatable magnet system extends parallel to the transport direction of the conveyor belt 11.

This part forms a conventional eddy-current separator 1, which enables particles X, Y of different conductivity to be separated. The electrically conductive particles X are deflected on the conveyor belt 11 above the rotating magnet system 14 and pass into a receiving vessel 15 next to the conveyor belt 11. The non-electrically conductive particles Y, for example of a plastics material, pass over the deflector roll 13 of the conveyor belt 11 into a receiving vessel 16.

The spatial arrangement of the receiving vessels 15, 16 can additionally be seen in FIG. 3, which presents an end view of the device according to the invention.

The cooling chamber 2 consists of a closed channel, which is formed from a U-shaped bottom part 22 and a cover 23.

Liquid nitrogen is fed into this closed channel 22, 23 of the cooling chamber 2 to cool the particles X, Y which are fed into it. The nitorgen flows through the channel 22, 23 and therefore cools in particular the surfaces of the particles. The nitrogen is thus guided in a casing about a cell, which contains a part of the conveyor belt and the magnetic field. The air in the cell is cooled to the desired operating temperature, preferably below 150 K, and maintained stable by an appropriate inflow of nitrogen. The material that is to be separated is cooled by thermal conduction and convection. As the eddy-current density is greatest at the material surface, complete temperature equalisation is not necessary. According to a very rough assessment, cooling takes place in the time <<1 s for aluminum and copper of a thickness of 1 mm, so that known eddy-current separators can be operated at the conveyor belt speeds which are usual at room temperature.

The channel 22, 23 is formed as a chute or shaker conveyor to transport the particles. The particles X, Y having thus passed through and been cooled fall onto the conveyor belt 11 at the delivery opening 21 and are transported over the rotating magnet system 14 by the conveyor belt 11, which consists of non-conductive material. Here the electrically conductive particles X undergo a material-dependent lateral deflection in accordance with their conductivity and density.

It is thus possible both to separate non-conductive substances, for example plastics materials, and electrically conductive non-ferrous metals, and to separate the non-ferrous metals from one another. As shown in FIG. 1, particles consisting of aluminum are deflected to a greater degree than particles consisting of magnesium, the latter are deflected to a greater degree than particles consisting of copper and the latter are deflected to a greater degree than particles consisting of zinc.

Greater separating accuracy between different non-ferrous metals is achieved by cooling the particles directly before they are deflected by the rotating magnet system.

The improved separating efficiency, which can thus be achieved, can establish industrial useful material cycles in the waste disposal sector. With valuable non-ferrous metals being for the most part separated strictly according to type, these may be re-used as "raw-materials" which are much in demand.

What is claimed is:

1. A device for separating non-ferrous metal particles of different electrical conductivity comprising:

a first transport system, comprising a cooling chamber having an input end and an output end through which said particles to be separated from one another are conveyed;

a second transport system having first end at said output end of said cooling chamber and an second end opposite from said first end, moving said particles in a linear first direction from said first end to said second end;

a magnetic eddy-current separator, disposed beneath said second transport system between said first end and said second end over which said cooled particles are transported, said eddy-current separator comprising a rotatable magnetic system having a rotational axis; and at least one collection container deposed alongside said second transport system.

2. The device of claim 1, wherein said cooling chamber is closed channel chute.

3. The device of claim 1, wherein said cooling chamber is closed channel shaker conveyor.

4. The device of claim 1, wherein said second transport system is a conveyor belt.

5. The device of claim 1, wherein said rotational axis of said rotatable magnetic system is aligned parallel to said first direction of said second transport system.

* * * * *